US005148856A

United States Patent [19]

Mueller et al.

[11] Patent Number: 5,148,856

[45] Date of Patent: Sep. 22, 1992

[54] DIRECT CHILL CASTING MOULD WITH CONTROLLABLE IMPINGEMENT POINT

[75] Inventors: Friedrich P. Mueller, Schifferstadt, Fed. Rep. of Germany; Guy LeBlanc, Longueuil, Quebec, Canada

[73] Assignee: Alcan International Limited, Montreal, Quebec, Canada

[21] Appl. No.: 717,851

[22] Filed: Jun. 11, 1991

Related U.S. Application Data

[63] Continuation of Ser. No. 446,100, Dec. 5, 1989, abandoned.

[30] Foreign Application Priority Data

Dec. 8, 1988 [CA] Canada ..... 585386

[51] Int. Cl.[5] ..... B22D 11/124

[52] U.S. Cl. ..... 164/487; 164/444

[58] Field of Search ..... 164/485, 486, 487, 443, 164/444

[56] References Cited

U.S. PATENT DOCUMENTS 3,612,151 10/1971 Harrington et al. ..... 164/487
3,688,834 9/1972 Wagstaff et al. ..... 164/444
3,713,479 1/1973 Bryson ..... 164/487
3,911,996 10/1975 Veillette .
3,933,192 1/1976 Rodenchuk et al. .
4,236,570 12/1980 Gaule et al. ..... 164/467
4,421,155 12/1983 Wagstaff ..... 164/436

FOREIGN PATENT DOCUMENTS 1188480 6/1985 Canada .

*Primary Examiner*—Kuang Y. Lin
*Attorney, Agent, or Firm*—Cooper & Dunham

[57] ABSTRACT

An apparatus and process are described for continuously casting molten metal. The apparatus includes (a) an open-ended direct chill casting mould comprising a mould plate having an inner axially extending wall or walls defining a mould cavity, (b) coolant delivery aperture or apertures adjacent the mould cavity adapted to discharge a stream or streams of coolant inwardly in the direction of metal movement to impinge on an ingot being formed, and (c) deflector means for deflecting the coolant stream or streams in a variable direction dependent on the local shrinkage conditions of the ingot being formed such that the coolant impinges upon the ingot at a constant distance below the mould plate around the periphery of the ingot and preferably at a constant relative impingement angle. The deflector means is preferably a movable baffle having a deflector face contoured to impart the desired deflection pattern to the coolant stream.

9 Claims, 5 Drawing Sheets

DIRECT CHILL CASTING MOULD WITH CONTROLLABLE IMPINGEMENT POINT

This is a continuation of application Ser. No. 446,100, filed Dec. 5, 1989 now abandoned.

FIELD OF THE INVENTION

This invention relates generally to the field of direct chill casting moulds having fluid cooling through an internal chamber and, more particularly, to such moulds with a controllable direct chill coolant impingement point.

BACKGROUND OF THE INVENTION

Direct chill casting is a technique in which aluminum or other molten metal is poured into the inlet end of an open-ended mould while liquid coolant is applied to the inner periphery of the mould to cool the mould plate and generate primary cooling. Also, the same or a different coolant is normally applied as secondary cooling to the surface of the ingot as it emerges from the outlet end of the mould, to continue the cooling effect on the solidifying metal. Where possible, the coolant is applied around the periphery of the mould or a portion thereof, as well as to the faces of the emerging ingot, to make the cooling effect as uniform as possible. However, because of the cross-sectional nature of the mould, the ingot does not cool at a uniform rate throughout the entire cross-section thereof and, moreover, the rate tends to vary not only with the location of the solidification profile in the ingot, but also with the rate at which the metal is being poured into the mould, the nature of the alloy being cast, the metal temperature and the casting speed. The metal along the side walls of the ingot tends to cool and shrink at an uneven rate, with the result that the side walls tend to withdraw inwardly a maximum amount at their centers and lose their flatness.

To obtain flat ingots, moulds have been devised which are capable of forming a crown on the wider side walls of a rectangular ingot to compensate for the uneven shrinkage which these side walls experience as the ingot solidifies. Also, moulds have been devised which are capable of adjusting the degree of deflection in the crown formed on these side walls of the ingot when the casting speed of the mould is increased from the initial low speed during the butt forming stage, to the higher operating speed during the remainder of the operation. For instance, U.S. Pat. No. 4,030,536 describes a system in which the relatively longer sides of the mould are flexed during the moulding operation to adjust the crown imparted to the wider side walls of the ingot.

While moulds of this type can provide a variable crown on the wider side walls of the ingot, there remains a problem of uneven cooling of the ingot because of an irregular impingement point of the coolant on the ingot. Thus, the ingot shrinks as soon as solidification begins so that the impingement point in standard moulds is in effect variable. This means that heat extraction is also non-uniform, especially in the center of the ingot where the shrinkage is highest.

Canadian Pat. No. 1,188,480 describes a direct chill casting method in which the impact point of liquid coolant on the emerging ingot can be varied nearer and farther away from the discharge end of the mould. This is done by directing a first coolant stream at a shallow angle in the direction of metal movement and providing a second coolant stream which converges with the first coolant stream such that by varying the volume and/or velocity of one or more streams, the point of coolant impact on the emerging ingot can be controlled.

It is an object of the present invention to provide a means for adjusting the coolant flow direction dependent upon local shrinkage conditions so that uniform impingement points and preferably constant relative impingement angles can be maintained over each face of the emerging ingot.

SUMMARY OF THE INVENTION

The mould device of the present invention has a mould plate of annular shape providing an internal moulding surface defining the periphery of an ingot to be cast and having an internal coolant passage for cooling the mould, together with a secondary coolant dispersal channel or channels communicating from the internal coolant passage outwardly in the direction of metal movement through outlets in a face of the mould adjacent the moulding surface. According to the novel feature, deflector means are provided which are adapted to engage the coolant streams emerging from the dispersal channel or channels and deflect the coolant streams in a variable direction dependent upon the shape of the adjacent emerging ingot, whereby the coolant impinges upon the ingot at a constant distance, and preferably a constant relative impingement angle, below the mould plate over each face of the emerging ingot. The deflector means can be either a mechanical deflector or fluid jets which engage and deflect the coolant streams.

According to a preferred embodiment, the mould plate is rectangular and movable deflector baffles are provided adjacent the long and short side of the mould. Each movable baffle may move either horizontally or vertically to engage the emerging secondary coolant streams. The surface of the baffle that engages the coolant streams is provided with a variable shape or contour. This variable shape is determined from the shape of the emerging ingot whereby the coolant streams are deflected such as to compensate for the variations in the shape of the ingot and thereby cause the coolant streams to impinge upon the emerging ingot at a uniform impingement point and preferably a constant relative angle.

Alternatively, it is possible to provide a contoured flow directing face on the mould itself adjacent the emerging coolant streams. This flow directing face then acts in combination with a movable deflector baffle to cause the coolant streams to impinge upon the emerging ingot at a uniform impingement point and preferably at a constant relative angle.

Another possibility is to provide a contoured water flow wherein the outlet water holes have a variable inclination with respect to the vertical axis and a variable distance from the mould face, thus achieving a uniform constant impingement point on the emerging ingot with a preferable constant relative impingement angle.

It is also possible to deflect the coolant streams in a variable pattern by fluid means. Thus, secondary jets of air or coolant may be used which intercept the main coolant streams such as to deflect the direction of the main coolant streams in a manner similar to that obtained with the deflector baffles.

In accordance with a further preferred embodiment, a coolant manifold is mounted under the mould and is in flow communication with the internal coolant passage.

This coolant manifold may also serve as a source of coolant for tertiary cooling of the ingot. Thus, coolant outlets may be provided in the side walls of the manifold, which outlets are connected to controllable coolant ejectors. This allows the operation of tertiary cooling independent from the secondary cooling.

The invention also relates to a process for producing metal ingot by the direct chill continuous casting process. Such process typically comprises the steps of:

(a) pouring molten metal into an open-ended thermally insulated annular top section having a flat bottom surface;

(b) allowing the molten metal to descend from the hot top section into a lower chilled mould section axially aligned with the hot top section and bring the molten metal into contact with the chilled mould section to produce a solidified peripheral layer or skin; and (c) withdrawing the metal continuously from the chilled mould section at a predetermined casting rate and applying streams of liquid coolant directly to the surface of the solidified peripheral layer of metal emerging from the chilled mould section. The improvement according to this invention comprises directing the liquid coolant streams such that they impinge on the emerging shrinking ingot at a uniform impingement point and preferably a constant relative angle. This involves providing a deflector face which is contoured in such manner as to compensate for the uneven rate of shrinking of the ingot so that the liquid coolant stream which are deflected by the deflector face impinge on the emerging ingot at a uniform impingement point and preferably a uniform impingement angle.

BRIEF DESCRIPTION OF THE DRAWINGS

The invention will be more fully understood from the following description of certain preferred embodiments thereof, given by way of example only, with reference to the accompanying drawings, in which.

Figure 1:
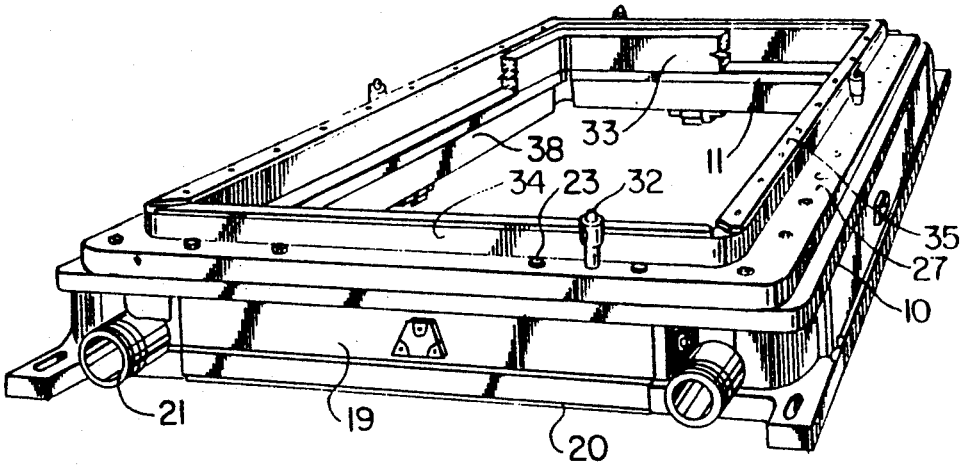
FIG. 1 is a perspective view of a mould assembly according to the invention.

The mould assembly of this invention has an open-ended rectangular annular body configuration. The mould plate 10 has a short vertical mould face 11, a top face 12 and a bottom face 13. This plate is conveniently manufactured from aluminum and includes coolant channels or slots 15 with a plurality of spaced dispersal channels 16 communicating between each coolant channel 15 and the bottom 13 of the mould plate 10. Preferably, a series of laterally spaced bores are used for the channels 15, each being closed at the outer end by a plug 44 and connecting at the inner end to a dispersal channel 16.

The coolant channels 15 are flow connected by way of a plurality of holes 17 to a coolant manifold 18 mounted on the bottom face 13 of mould plate 10. The coolant manifold 18 is manufactured with heavy side walls 19 and a bottom wall 20. The heavy side walls 19 of each coolant manifold serve a significant structural purpose in that they provide rigidity to the moulding plate 10. The coolant manifold 18 is mounted to the bottom of the mould plate 10 by means of studs or bolts 23 which also extend through frame members 27. The faces between the coolant manifold and the mould plate are sealed by O-rings.

With this system, water flows under pressure into the manifold reservoir 40 through inlet 21 and from here flows through screen 41 and upwardly through hole 42 in a coolant regulating plate 14. This regulating plate serves to direct the flow of coolant upwardly through holes 17 in a uniform manner. The coolant then flows along the channel or channels 15 extending parallel to the top face of the mould plate. In a typical design, the channels 15 are bores having a diameter of about 4 mm and spaced from each other by a distance of about 6 mm. The tops of the channels 15 are preferably only a short distance below the top face of the mould, e.g. no more than about 10 mm to assure a good cooling effect on the outer face of the mould.

Figure 3:
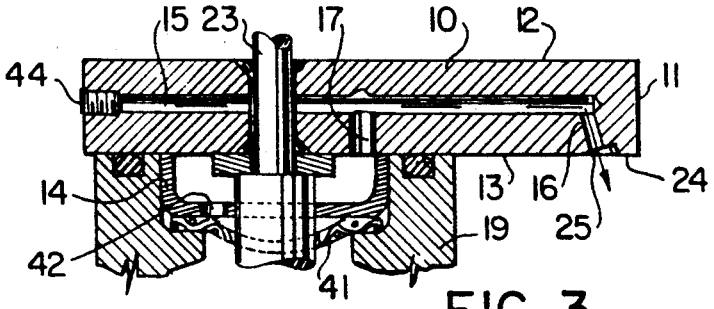
FIG. 3 is a sectional view showing details of the mould plate of FIG. 2.
Figure 4:
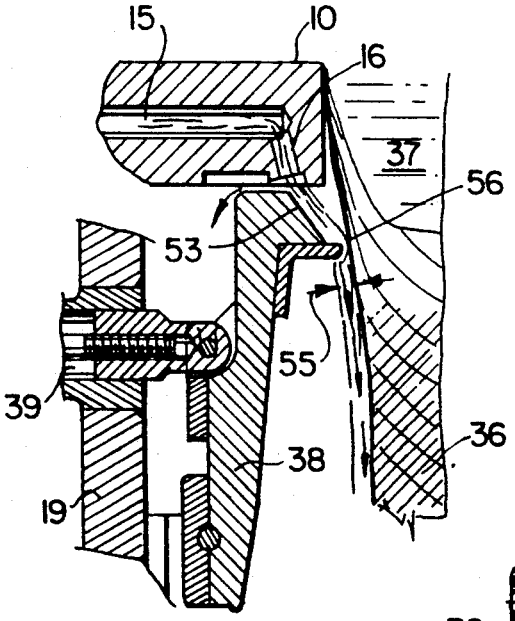
FIG. 4 is a sectional view showing details of a baffle in a first position.
Figure 5:
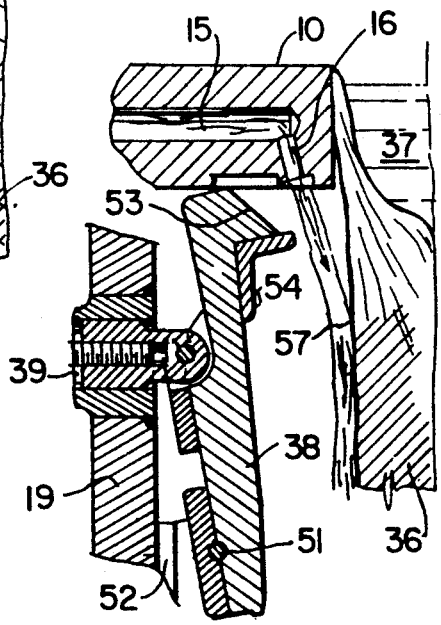
FIG. 5 is a sectional view showing details of a baffle in a second position.

The water flowing through the channels 15 flows out through dispersal passages 16. These outlet passages 16 are, as shown in FIG. 3, on a champhered bottom face portion 25 spaced from the mould face by a narrow downwardly projecting lip 24.

The inlet portion of the mould assembly includes an insulating head 33 which generally conforms to the shape of the mould with which it is associated. This insulating head is formed of a heat resistant and insulating material, such as a refractory material, which will not deteriorate when in contact with the molten metal to be cast. This insulating head 33 is located at a position contiguous with or adjacent to and extending around the periphery of the top portion of the mould wall face 11. This insulating head provides for relatively constant withdrawal of heat from the molten metal during the casting operation when using a short mould wall. The insulating material 33 is held in place by frame members 27 and top plates 35. These are preferably made from aluminum and are pressed against the mould plate 10 by means of bolt 23. Each frame member 27 includes recesses 28 which hold O-rings to provide a seal against the top face of the mould. An oil plate 31 is preferably sandwiched between the frame member 27 and insulating head 33 on the one side and the mould plate 10 on the other side. This oil plate 31 contains grooves in the lower face thereof to deliver oil to the mould face 11 and is flow connected at the inner edge thereof by way of oil channel or channels 29 to an oil chamber 30 formed within the frame member 27. Oil is supplied to the chamber via valve connector 32.

Figure 2:
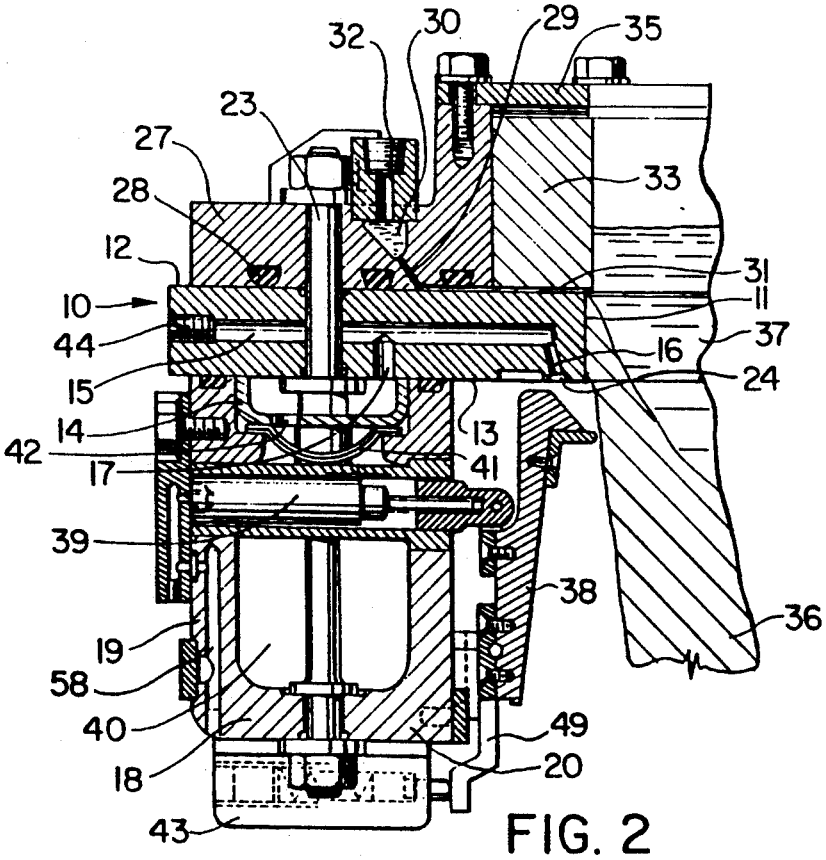
FIG. 2 is a sectional view of a mould assembly according to the invention.

In operation, molten metal 37 is fed into the inlet consisting of the insulating head 33. Preferably cooling takes place by contact with the mould face 11 and an outer skin is formed. This outer skin is sprayed with cooling water below the mould skirt to provide further solidification and this causes a shrinkage of the ingot as shown in FIG. 2.

A principal feature of the present invention is embodied in the deflector baffle 38 mounted directly beneath the bottom face 13 of mould plate 10. This deflector baffle 38 is designed to move laterally such that a deflector face moves out of and into engagement with the coolant streams discharging from dispersal channels 16.

One embodiment of the deflector baffle arrangement can be seen in FIGS. 2–5. Thus, the baffle consists of a body portion 38 extending along beneath an edge of the mould plate and this baffle 38 is pivotally mounted by means of pivot pins 51 to brackets 52 fixed to side wall 19 of coolant manifold 18. The upper part of the deflector body includes an inclined deflector face 53 which is specially shaped as defined hereinafter. Immediately below the deflector face 53 is positioned a narrow stop member 54 which prevents the deflector baffle from coming into direct contact with forming ingot 36 and thereby provides a minimum water flow gap 55. In the position shown in FIG. 4 the coolant contacts the forming ingot 36 at a high impingement point 56, while the coolant in FIG. 5 contacts the forming ingot 36 at a low impingement point 57.

An arm 49 is fixed to the baffle 38 and projects downwardly below the pivot 51 to engage a spring member 43. This spring member pushes outwardly against the arm 49 thereby urging the deflector face 53 in a direction away from the ingot 36.

The deflector face 53 is moved out of and into engagement with the coolant streams emerging from the dispersal channel 16 by means of actuator mechanism 39. This is in the form of a cylinder which can be actuated to urge the deflector face 53 into engagement with the water stream. A fluid may be supplied to the cylinder 39 by way of manifold 58.

Figure 6:
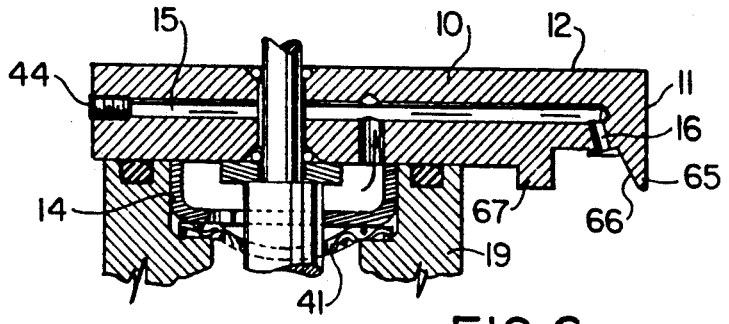
FIG. 6 is a sectional view showing details of a second mould plate design.
Figure 7:
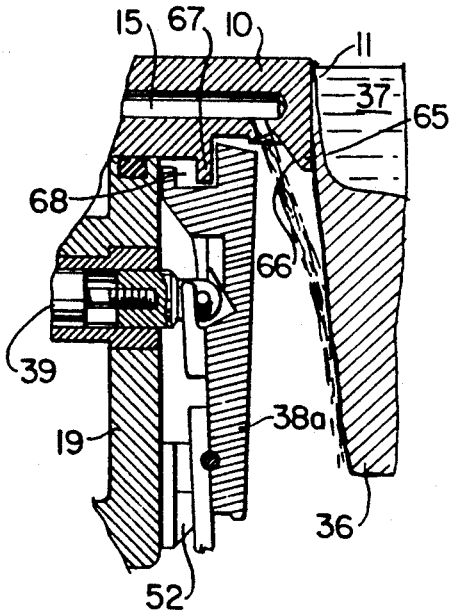
FIG. 7 is a sectional view showing details of a further baffle in a first position.
Figure 8:
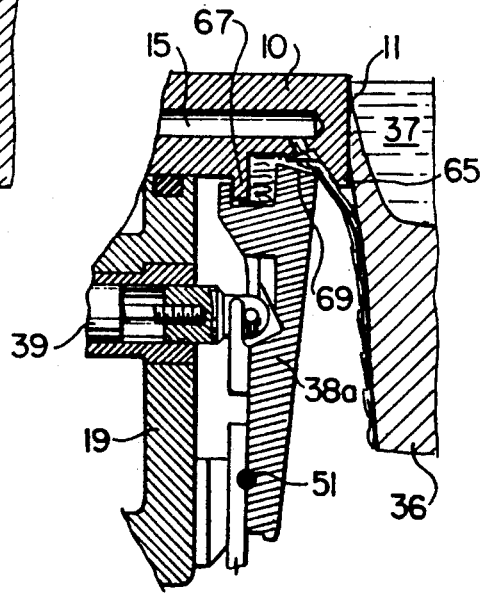
FIG. 8 is a sectional view showing details of a further baffle in a second position.

An alternative form of the coolant discharge arrangement and deflector baffle are shown in FIGS. 6–8. The basic structure of the mould assembly and baffle are similar to that shown in FIGS. 2–5, but the coolant discharge portion of the mould plate 10 is modified by providing a deep recess into the bottom face 13 so as to provide a relatively deep downwardly projecting skirt or shroud 65. The inner face of this skirt or shroud comprises an inclined deflector face 66. The inner edge of the recess includes a downwardly projecting abutment member 67.

The baffle member **38*a* at the upper end thereof includes a downwardly extending slot 68 with side edges into which slot the abutment 67 projects. Thus, the abutment 67 limits lateral movement of the baffle 38*a* between the inner edge faces of the slot 68. The upper edge of the baffle of this embodiment also includes a tapered deflector face 69**.

With both of the deflector designs described above, coolant deflector faces are provided which cause the coolant streams to impinge upon the emerging ingot at a uniform impingement point and preferably at a constant relative angle. This is achieved by providing either a baffle deflector face 53 with a varying contour or providing a deflector baffle 69 with a fixed contour and a projecting skirt inner face 66 with a varying contour.

Figure 11:
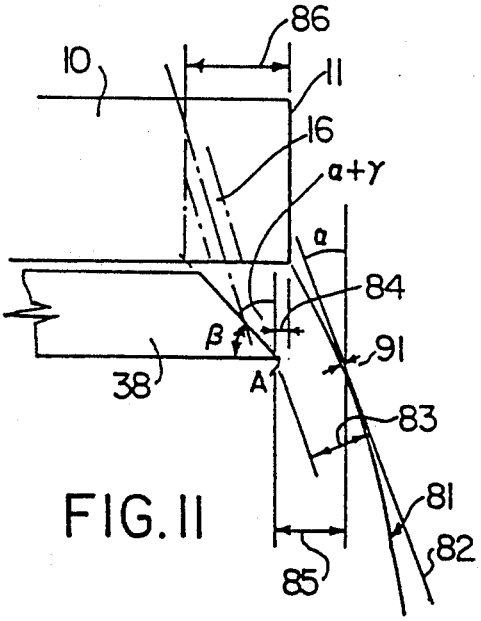
FIG. 11 is a schematic illustration showing coolant flow patterns for the embodiment of FIG. 2.
Figure 12:
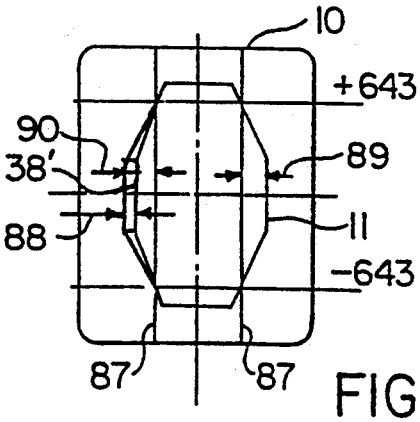
FIG. 12 is a schematic illustration which compares the mould and baffle profiles.

For the design of the contoured deflector face 53, the shape is achieved by variation in shape and angle in accordance with FIGS. 11 and 12 and the dimensions shown in Table 1. As will be seen in FIG. 11, the deflector 38 has an outer edge tip A and this deflector moves laterally beneath the coolant outlet 16 of mould plate 10. The ingot 36 forms a profile 81 as it shrinks and line 82 represents the tangent of the ingot profile at the coolant impingement point 91. The water gap provided with the positioning of the deflector 38 is shown by the space 83, while the distance 84 represents the relative distance between the mould profile 11 and the baffle edge A. The distance of the ingot surface from the baffle edge A is shown by the dimension 85. The upper edge of the deflector face 53 bisects the bottom face of mould plate 10 at a distance from edge face 11 represented by the dimensional line 86. The angle alpha ($\alpha$) is the angle of inclination of the tangent line 82 to the vertical, while the angle gamma ($\gamma$) is the preferred constant relative impingement angle.

As will be seen in FIG. 12, the inner profile or inner edge of the mould plate 10 is shown by the line 11. In the schematic view of FIG. 12, the baffle 38 is represented, for convenience of illustration, by a notional line 38' spaced inwardly (i.e., toward the longitudinal axis of the mould opening) from the baffle edge tip A by a fixed distance of 3.00 mm as measured in a direction perpendicular to the longitudinal axis of the mould. In the following discussion, line 38' will be termed the baffle line, and it will be appreciated that the position of each point along the length of tip A is precisely defined by the position of the corresponding point on line 38'. As line 38' represents, the baffle 38 is shorter than the mould opening and this terminates within the mould opening at the lines indicated as +643 and −643 indicating a distance of 643 mm from the center line of the mould opening. The lines 87 represents lines running parallel to the longitudinal axis of the mould opening and intersecting the ends of the baffle 38. The dimension 88 represents the distance between the profiles, of the mould face and the profile of the baffle line 38', while the dimension 89 shows the deviation of the mould face from line 87 and the line 90 shows the deviation of the baffle line 38' from line 87.

The system was designed on the basis of the dimensions shown in Table 1 below. The terms used in Table 1 have the following meanings:

Edge Distance—The distance along the longitudinal axis of the baffle from the centerline where each measurement was made.

Mould Deviation—This is the distance 89 shown in FIG. 12 between the mould face and the line 87.

Mould/Baffle—This is the distance 88 between the profiles of the mould face and the baffle line 38'.

Angle Alpha—This is the angle of inclination of the tangent line 82 to the vertical.

Baffle Deviation—This is the distance 90 between the baffle line 38' and line 87.

Point A—This is the distance 84 of the baffle edge A from the mould profile 11. A negative value indicates that edge A has moved within the mould profile.

Intersection of Mould—This is the distance 86 shown in FIG. 11.

For the mould used, the ingot profile was measured during casting at different points around the ingot. Curves representing the ingot profile were then plotted and a tangent line 82 was drawn at the desired impingement point. The angle $\alpha$ was determined between the vertical and tangent line 82. Dimensions for the baffle design were then established based on the desired specific impingement point, the angle $\alpha$, the relative water impingement angle and the desired water gap.

TABLE 1

| Edge Distance mm | Mould Deviation mm | Mould/Baffle mm | Angle Alpha | Baffle Deviation mm | Point A mm | Intersection of Mould mm |
|---|---|---|---|---|---|---|
| 0 | 21.35 | 3.25 | 12.37 | 18.10 | −0.25 | 11.15 |
| 10 | 21.35 | 3.25 | 12.37 | 18.10 | −0.25 | 11.15 |
| 20 | 21.35 | 3.25 | 12.37 | 18.10 | −0.25 | 11.15 |
| 30 | 21.35 | 3.25 | 12.37 | 18.10 | −0.25 | 11.15 |
| 40 | 21.35 | 3.25 | 12.37 | 18.10 | −0.25 | 11.15 |
| 50 | 21.35 | 3.25 | 12.37 | 18.10 | −0.25 | 11.15 |
| 60 | 21.35 | 3.25 | 12.37 | 18.10 | −0.25 | 11.15 |
| 70 | 21.35 | 3.25 | 12.37 | 18.10 | −0.25 | 11.15 |
| 80 | 21.35 | 3.25 | 12.37 | 18.10 | −0.25 | 11.15 |
| 90 | 21.35 | 3.25 | 12.37 | 18.10 | −0.25 | 11.15 |
| 97 | 21.35 | 3.25 | 12.37 | 18.10 | −0.25 | 11.15 |
| 100 | 21.18 | 3.22 | 12.29 | 17.96 | −0.22 | 11.15 |
| 110 | 20.79 | 3.16 | 12.08 | 17.63 | −0.16 | 11.13 |
| 120 | 20.40 | 3.10 | 11.87 | 17.30 | −0.10 | 11.10 |
| 130 | 20.01 | 3.04 | 11.66 | 16.97 | −0.04 | 11.08 |
| 140 | 19.62 | 2.98 | 11.45 | 16.64 | 0.02 | 11.06 |
| 150 | 19.23 | 2.92 | 11.24 | 16.31 | 0.08 | 11.04 |
| 160 | 18.84 | 2.86 | 11.04 | 15.98 | 0.14 | 11.02 |
| 170 | 18.45 | 2.80 | 10.83 | 15.65 | 0.20 | 11.00 |
| 180 | 18.06 | 2.74 | 10.62 | 15.32 | 0.26 | 10.98 |
| 190 | 17.67 | 2.68 | 10.40 | 14.99 | 0.32 | 10.96 |
| 200 | 17.28 | 2.62 | 10.19 | 14.66 | 0.38 | 10.94 |
| 210 | 16.89 | 2.56 | 9.98 | 14.33 | 0.44 | 10.92 |
| 220 | 16.50 | 2.50 | 9.77 | 14.00 | 0.50 | 10.90 |
| 230 | 16.11 | 2.45 | 9.56 | 13.66 | 0.55 | 10.88 |
| 240 | 15.72 | 2.39 | 9.35 | 13.33 | 0.61 | 10.86 |
| 250 | 15.33 | 2.33 | 9.13 | 13.00 | 0.67 | 10.84 |
| 260 | 14.94 | 2.27 | 8.92 | 12.67 | 0.73 | 10.82 |
| 270 | 14.55 | 2.21 | 8.71 | 12.34 | 0.79 | 10.81 |
| 280 | 14.16 | 2.15 | 8.49 | 12.01 | 0.85 | 10.79 |
| 290 | 13.77 | 2.09 | 8.28 | 11.68 | 0.91 | 10.77 |
| 300 | 13.38 | 2.03 | 8.06 | 11.35 | 0.97 | 10.76 |
| 310 | 12.99 | 1.97 | 7.85 | 11.02 | 1.03 | 10.74 |
| 320 | 12.60 | 1.91 | 7.63 | 10.69 | 1.09 | 10.73 |
| 330 | 12.21 | 1.85 | 7.42 | 10.36 | 1.15 | 10.71 |
| 340 | 11.82 | 1.79 | 7.20 | 10.03 | 1.21 | 10.70 |
| 350 | 11.43 | 1.73 | 6.99 | 9.70 | 1.27 | 10.69 |
| 360 | 11.04 | 1.67 | 6.77 | 9.37 | 1.33 | 10.67 |
| 370 | 10.65 | 1.61 | 6.55 | 9.04 | 1.39 | 10.66 |
| 380 | 10.26 | 1.55 | 6.34 | 8.71 | 1.45 | 10.64 |
| 390 | 9.87 | 1.49 | 6.12 | 8.38 | 1.51 | 10.63 |
| 400 | 9.48 | 1.43 | 5.90 | 8.05 | 1.57 | 10.62 |
| 410 | 9.09 | 1.37 | 5.69 | 7.72 | 1.63 | 10.61 |
| 420 | 8.70 | 1.31 | 5.47 | 7.39 | 1.69 | 10.60 |
| 430 | 8.31 | 1.25 | 5.25 | 7.06 | 1.75 | 10.58 |
| 440 | 7.92 | 1.19 | 5.03 | 6.73 | 1.81 | 10.57 |
| 450 | 7.53 | 1.13 | 4.81 | 6.40 | 1.87 | 10.56 |
| 460 | 7.14 | 1.07 | 4.59 | 6.07 | 1.93 | 10.55 |
| 470 | 6.75 | 1.02 | 4.37 | 5.73 | 1.98 | 10.53 |
| 480 | 6.36 | 0.96 | 4.15 | 5.40 | 2.04 | 10.52 |
| 490 | 5.97 | 0.90 | 3.93 | 5.07 | 2.10 | 10.51 |
| 500 | 5.58 | 0.84 | 3.71 | 4.74 | 2.16 | 10.50 |
| 510 | 5.19 | 0.78 | 3.49 | 4.41 | 2.22 | 10.49 |
| 520 | 4.80 | 0.72 | 3.27 | 4.08 | 2.28 | 10.48 |
| 530 | 4.41 | 0.66 | 3.05 | 3.75 | 2.34 | 10.47 |
| 540 | 4.02 | 0.60 | 2.83 | 3.42 | 2.40 | 10.47 |
| 550 | 3.63 | 0.54 | 2.61 | 3.09 | 2.46 | 10.46 |
| 560 | 3.24 | 0.48 | 2.39 | 2.76 | 2.52 | 10.45 |
| 570 | 2.85 | 0.42 | 2.17 | 2.43 | 2.58 | 10.44 |
| 580 | 2.46 | 0.36 | 1.95 | 2.10 | 2.64 | 10.44 |
| 590 | 2.07 | 0.30 | 1.73 | 1.77 | 2.70 | 10.43 |
| 600 | 1.68 | 0.24 | 1.50 | 1.44 | 2.76 | 10.42 |
| 610 | 1.29 | 0.18 | 1.28 | 1.11 | 2.82 | 10.41 |
| 620 | 0.90 | 0.12 | 1.06 | 0.78 | 2.88 | 10.41 |
| 630 | 0.51 | 0.06 | 0.84 | 0.45 | 2.94 | 10.40 |
| 640 | 0.12 | 0.00 | 0.62 | 0.12 | 3.00 | 10.40 |
| 643 | 0.00 | 0.00 | 0.55 | 0.02 | 3.02 | 10.40 |

Figure 14:
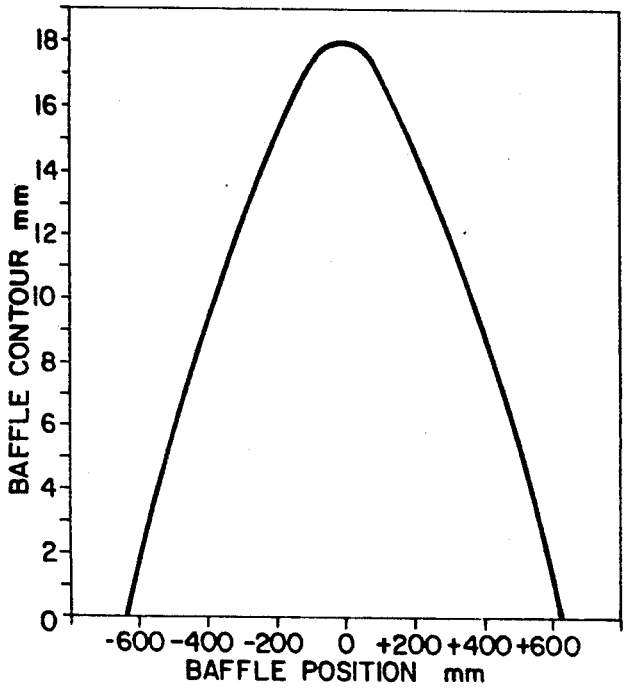
FIG. 14 is a plot showing variations in contour along the length of a baffle.
Figure 15:
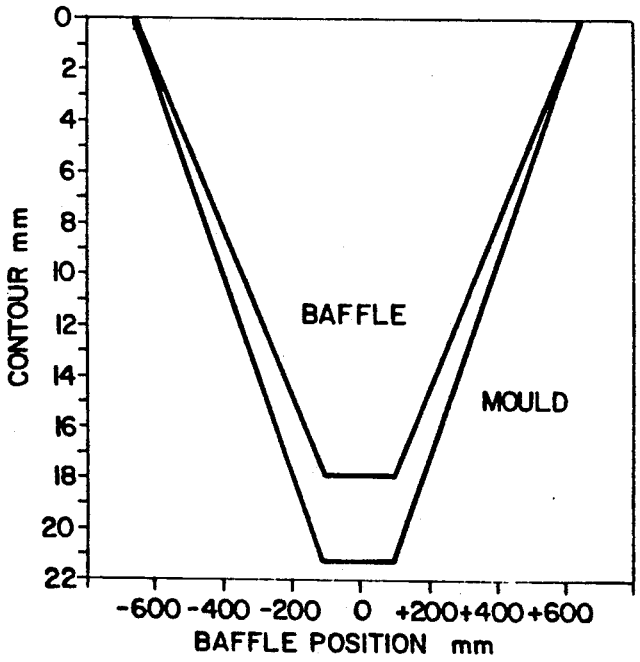
FIG. 15 is a plot showing the relative contours of the mould face and baffle.

The contours formed by Table 1 above are shown graphically in FIGS. 14 and 15 as applied to an ingot measuring 600×1345 mm.

Figure 13:
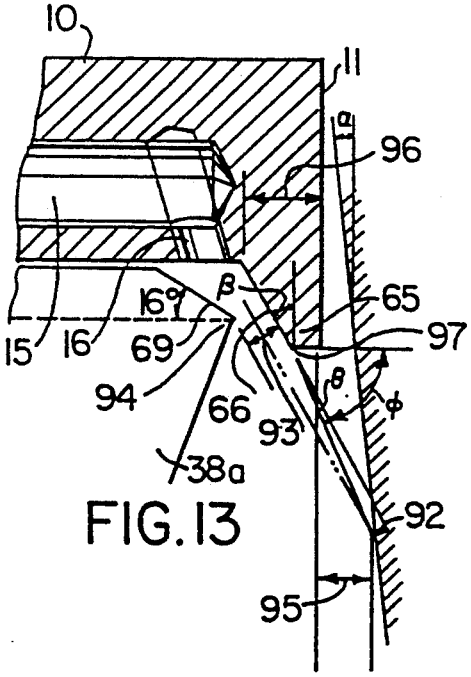
FIG. 13 is a schematic illustration showing the basis for determining a mould plate deflector shape.

For the embodiment of FIGS. 6–8, the contour of face 66 is achieved in accordance with FIG. 13. In FIG. 13, the angle $\alpha$ is the variable angle of the edge face of the ingot to the vertical, the impingement point 92 is 7 mm below the bottom face of mould plate 10 and the water gap 93 is 1.9 mm. The angle $\phi$ is a variable angle between the horizontal and the centerline of the water curtain, while the angle $\theta$ is the variable angle between the contoured face 66 and the straight line joining impingement point 92 to the bottom edge 97 of contoured face 66. The angle 94 of the baffle face 69 to the horizontal is fixed at 16°, while the angle $\beta$ of face 66 to the vertical is variable. The distance 95 between the mould face 11 and the impingement 92 is variable depending upon local shrinkage conditions, as is the distance 96 between mould face and contoured face 66. The important consideration here is the angle $\beta$ which is variable and is varied in relation to the forming shape of the ingot. Amounts for the variable can easily be determined on the same basis as were described for the embodiment of FIGS. 3–5.

Figure 9:
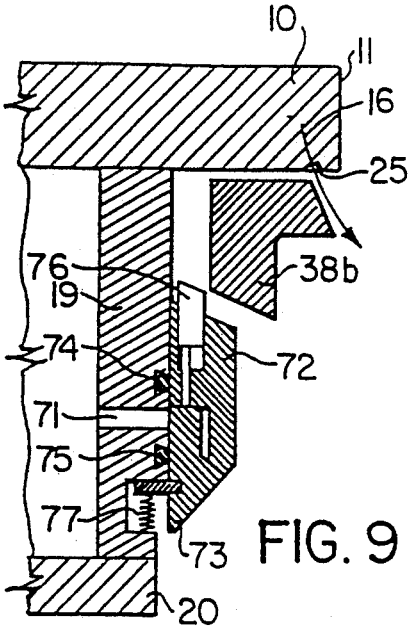
FIG. 9 is a sectional view of a tertiary cooling system in closed position.
Figure 10:
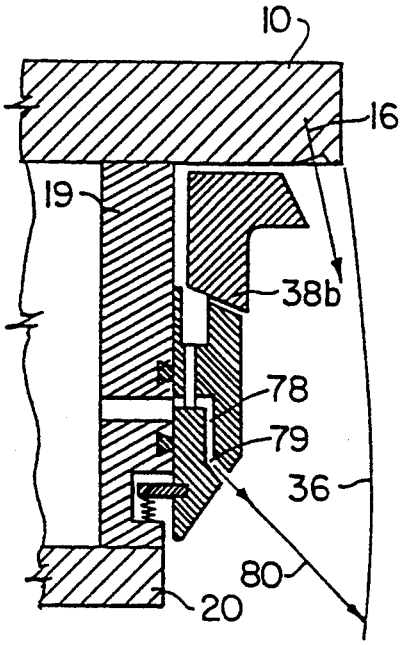
FIG. 10 is a sectional view of the embodiment of FIG. 9 in open position.

It is sometimes also desirable to provide tertiary cooling and one such tertiary cooling arrangement is shown in FIGS. 9 and 10. Here, holes 71 are provided in manifold side wall 19 and a flow control system is provided consisting of a fixed baffle member 72 and a vertically movable baffle member 73. These baffles seal to the surface of side wall 19 by way of O-rings 74 and 75. Mounted within the fixed baffle 72 is a vertically movable plunger 76. This plunger engages the movable baffle 73 and moves it downwardly against the resistance of spring 77. When the movable baffle 73 is moved downwardly by means of deflector **38*b*, it opens a coolant channel 78 with an inclined outlet 79 whereby a stream of tertiary coolant 80** is directed against the ingot.

It is obvious that various modifications and alterations may be made in this invention without departing from the spirit and scope thereof and it is not to be taken as limited except by the appended claims herein.

We claim:

1. An apparatus for continuously casting molten metal comprising:

(a) an open-ended direct chill casting mould comprising a mould plate having inner axially extending walls defining a rectangular mould cavity with opposed long side walls and short side walls, (b) coolant delivery apertures adjacent at least the mould cavity long side walls adapted to discharge streams of coolant inwardly at an angle in the direction of metal movement to impinge on an ingot being formed, and (c) deflector means having a varying contoured face for deflecting the coolant streams in a variable direction dependent on the local shrinkage conditions of the rectangular ingot being formed such that the coolant impinges upon the ingot at a constant distance below said mould plate around the periphery of the ingot, said deflector means being a baffle having a contoured deflector face adapted to deflect the coolant streams in compensation for the outside solidification profile of the forming ingot.

2. An apparatus according to claim 1 wherein a coolant manifold is mounted on the downstream side of the mould, said manifold including discharge means for separately discharging coolant onto the skin of the forming ingot.

3. An apparatus for continuously casting molten metal comprising:

(a) an open-ended direct chill casting mould comprising a mould plate having inner axially extending walls defining a rectangular mould cavity with opposed long side walls and short side walls, (b) coolant delivery apertures adjacent at least the mould cavity long side walls adapted to discharge streams of coolant inwardly at an angle in the direction of metal movement to impinge on an ingot being formed, and (c) deflector means having a varying contoured face for deflecting the coolant streams in a variable direction dependent on the local shrinkage conditions of the rectangular ingot being formed such that the coolant impinges upon the ingot at a constant distance below said mould plate around the periphery of the ingot, said deflector means being a movable baffle having a contoured deflector face adapted to deflect the coolant streams in compensation for the outside solidification profile of the forming ingot.

4. An apparatus according to claim 3 wherein the baffle has at least one projecting finger for maintaining a minimum distance of the baffle from the ingot and providing a constant flow gap between the baffle and the forming ingot.

5. An apparatus according to claim 3 wherein the baffle is pivotally mounted.

6. An apparatus for continuously casting molten metal comprising:

(a) an open-ended direct chill casting mould comprising a mould plate having inner axially extending walls defining a rectangular mould cavity with opposed long side walls and short side walls, (b) coolant delivery apertures adjacent at least the mould cavity long side walls adapted to discharge streams of coolant inwardly at an angle in the direction of metal movement to impinge on an ingot being formed, (c) a downwardly extending skirt on said mould plate adjacent the coolant delivery apertures, said skirt having a varying contoured face adapted to be engaged by the coolant streams and deflect them such that the coolant streams impinge on the long sides of the emerging rectangular ingot at a uniform impingement point, and (d) a movable coolant baffle adapted to direct emerging coolant streams into engagement with said contoured skirt face.

7. An apparatus for continuously casting molten metal comprising:

(a) an open-ended direct chill casting mould comprising a mould plate having inner axially extending walls defining a rectangular mould cavity with opposed long side walls and short side walls, (b) coolant delivery apertures adjacent at least the mould cavity long side walls adapted to discharge streams of coolant inwardly at an angle in the direction of metal movement to impinge on an ingot being formed, (c) a downwardly extending skirt on said mould plate adjacent the coolant delivery apertures, said skirt having a contoured face of varying angle to the vertical along the length thereof adapted to be engaged by the coolant and deflect it such that the coolant impinges on the long sides of the emerging rectangular ingot at a uniform impingement point, and (d) a coolant baffle adapted to direct coolant streams emerging from said apertures into engagement with said contoured skirt face, said baffle having a deflector face of constant downward and outward angle and terminating in an outer edge, said outer edge having a contour corresponding to the contour of said skirt face thereby providing a coolant gap of substantially uniform width between said baffle outer edge and said contoured skirt face.

8. In a process for the production of rectangular metal ingots by the direct chill continuous casting process comprising the steps of (a) pouring molten metal into an open-ended thermally insulated hot top section, (b) allowing the molten metal to descend from said hot top section into a lower chilled rectangular mould section axially aligned with said hot top section and bring said molten metal into contact with said chilled mould section to produce a solidified peripheral layer, and (c) withdrawing the metal continuously from the chilled rectangular mould section at a predetermined casting rate and applying liquid coolant directly to the surface of the solidified peripheral layer of metal emerging from the chilled mould section, the improvement which comprises deflecting the direction of the liquid coolant streams in a pattern determined by the shrink pattern of at least the long sides of the emerging rectangular ingot such that the coolant streams impinge on the emerging ingot at a uniform impingement point on all sides thereof, said coolant streams being deflected by engaging a varying contoured deflector face of a baffle which is laterally movable.

9. In a process for the production of rectangular metal ingots by the direct chill continuous casting process comprising the steps of (a) pouring molten metal into an open-ended thermally insulated hot top section.

(b) allowing the molten metal to descend from said hot top section into a lower chilled rectangular mould section axially aligned with said hot top section and bring said molten metal into contact with said chilled mould section to produce a solidified peripheral layer, and (c) withdrawing the metal continuously from the chilled rectangular mould section at a predetermined casting rate and applying liquid coolant directly to the surface of the solidified peripheral layer of metal emerging from the chilled mould section, the improvement which comprises deflecting the direction of the liquid coolant streams in a pattern determined by the shrink pattern of at least the long sides of the emerging rectangular ingot such that the coolant streams impinge on the emerging ingot at a uniform impingement point on all sides thereof, said coolant streams being delfected by engaging a first deflector face of constant downward and outward angle to the horizontal and terminating in a contoured outer edge and said coolant thereafter engaging a second deflector face of varying angle to the vertical along the length thereof to provide a contoured face causing the coolant impingement on the ingot at a uniform impingement point, said first deflector face contoured outer edge having a contour corresponding to the contour of said second deflector face thereby providing a coolant gap of substantially uniform width between said first and second deflector faces.

* * * * *